United States Patent [19]

Van Broekhoven et al.

[11] 4,263,530

[45] Apr. 21, 1981

[54] WARM WHITE FLUORESCENT LAMP HAVING GOOD EFFICACY AND COLOR RENDERING

[75] Inventors: Jacob Van Broekhoven, North Caldwell; Richard Corth, Nutley, both of N.J.

[73] Assignee: Westinghouse Electric Corp., Pittsburgh, Pa.

[21] Appl. No.: 58,574

[22] Filed: Jul. 17, 1979

[51] Int. Cl.[3] ..... H01J 61/44

[52] U.S. Cl. ..... 313/487

[58] Field of Search ..... 313/487

[56] References Cited

U.S. PATENT DOCUMENTS

| | | |
|---|---|---|
| 2,488,733 | 11/1949 | McKeag et al. . |
| 3,602,758 | 8/1971 | Thornton et al. . |
| 4,075,532 | 2/1978 | Piper et al. . |
| 4,079,287 | 3/1978 | Soules et al. . |

*Primary Examiner*—Palmer C. Demeo

*Attorney, Agent, or Firm*—W. D. Palmer

[57] ABSTRACT

Fluorescent lamp has warm-white color and both high efficacy and good color rendition. This performance is achieved by utilizing a broad-band-emitting apatite-structured calcium fluorophosphate activated by predetermined percentages of antimony and manganese and narrow red-orange-emitting yttrium oxide activated by a predetermined percentage of tervalent europium.

3 Claims, 5 Drawing Figures

WARM WHITE FLUORESCENT LAMP HAVING GOOD EFFICACY AND COLOR RENDERING

BACKGROUND OF THE INVENTION

This invention generally relates to fluorescent lamps and, more particularly, to an improved fluorescent lamp of warm-white color which has both good efficacy and good color rendering properties.

Fluorescent lamps are fabricated to provide various color temperatures of emission which generally correspond to the color temperature of a complete or full radiator maintained at the specified temperature. A warm-white color is specified as being about 3000° K. and cool-white color is specified as being about 4100° K. For illumination in the home, the public seems to prefer the warm color, possibly due to long-time familiarity with the incandescent lamp which has a warm color.

A standard warm-white fluorescent lamp designed to operate with a color temperature of about 3,000° K. is normally fabricated with a halophosphate phosphor, such as generally described in U.S. Pat. No. 2,488,733, dated Nov. 22, 1949, to McKeag et al. More specifically, such a phosphor is normally apatite-structured calcium fluoro-chlorophosphate, activated by antimony plus manganese, preferably with a small addition of cadmium. Such lamps have reasonably good lumen output, a representative output for a 40WT12 lamp being 3100 lumens, but the color rendering properties of such lamps are relatively poor. Fluorescent lamps having a warm-white color and relatively good color rendering properties are available on the market, and these lamps incorporate a phosphor comprising about 90% by weight strontium magnesium phosphate activated by tin, 5% by weight manganese-activated zinc silicate, and 5% by weight of a blue halophosphate, which is calcium fluoroapatite activated by antimony. The lumen output of these lamps is relatively poor, however, and a considerable sacrifice in lumens is made in order to obtain the good color rendering properites.

The internationally accepted procedure for standardizing and measuring the color rendering properties of light sources is set forth in the publication of The International Commission on Illumination, identified as publication C.I.E. No. 13 (E-1.3.2) 1965. More recently, a color-preference index has been proposed for rating the performance of light sources in accordance with what the normal observer considers to be the preferred coloration for familiar objects. This color preference index (CPI) is summarized in the Journal of the Illuminating Engineering Society, pages 48–52 (October 1974) article entitled "A Validation of the Color-Preference Index" by W. A. Thornton.

In U.S. Pat. No. 4,079,287, dated Mar. 14, 1978 to Soules et al is disclosed a fluorescent lamp which utilizes a mixture of strontium chloro-fluoroapatite activated by antimony and manganese and yttrium oxide activated by tervalent europium, in order to obtain an improved efficacy as compared to a so-called deluxe-type lamp, while still providing a good color rendering index. The lumen figures which are reported, however, are inferior to the standard fluorescent lamps which use halophosphate phosphor and which have a lower color rendering index.

In U.S. Pat. No. 4,075,532, dated Feb. 21, 1978 to Piper et al. is disclosed a fluorescent lamp having a cool-white color which utilizes a mixture of calcium fluoroapatite activated by antimony and manganese, which is a broad-band emitting phosphor having an emission peaked in the yellow region of the visible spectrum, together with strontium chloroapatite activated by divalent europium, which is a narrow-band emitter peaked in the blue-violet region of the visible spectrum. The phosphors are mixed in predetermined proportions in order to provide a cool-white emission which has improved luminosity over the standard halophosphate phosphor, but with a somewhat decreased color rendering index.

In U.S. Pat. No. 3,602,758, dated Aug. 31, 1971 to Thornton et al is disclosed a fluorescent lamp which utilizes a double layer of phosphor, with the more expensive phosphor positioned nearest to the discharge to cause it to "work harder" so that less of this more expensive phosphor will be utilized. More specifically, the phosphor which is furthest from the discharge is a mixture of manganese activated zinc silicate, strontium blue halophosphate and strontium magnesium phosphate activated by tin, with a relatively expensive yttrium oxide activated by tervalent europium coated thereover.

SUMMARY OF THE INVENTION

There is provided a fluorescent lamp having a warm-white color and combined high efficacy and good color rendition, wherein the lamp comprises a sealed, elongated, light-transmitting envelope having electrodes operatively positioned therein proximate the ends thereof and enclosing a discharge-sustaining filling comprising mercury and a small charge of inert, ionizable starting gas. When energized, the dishcarge-sustaining filling generates ultraviolet radiations and a limited proportion of visible radiations. Phosphor is carried on the interior surface of the envelope and comprises predetermined amounts and relative proportions of apatite-structured calcium fluorophosphate activated by antimony and manganese, and yttrium oxide activated by tervalent europium. The activator proportions are limited to specified weight percentages, in order to provide the desired emissions and the calcium fluoroapatite phosphor is responsive to the ultraviolet radiations generated by the discharge to provide a broad-band emission of visible radiations. The yttrium oxide phosphor is responsive to the ultraviolet radiations generated by the discharge to provide a narrow emission in the red-region of the visible spectrum. The predetermined amounts and relative proportions of the calcium fluoroapatite and yttrium oxide phosphor are such that the total visible emissions from the energized lamp fall within the warm-white ellipse as inscribed on the x-y chromaticity ICI diagram. In actual, performance, the lumen output of the resulting lamp is better than that obtained with a standard warm-white lamp of the same color which utilizes the halophosphate phosphor per se, and the color rendering index approaches that which is obtained with a deluxe lamp which has a much poorer luminosity.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
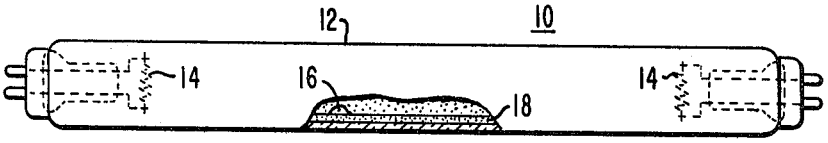
FIG. 1 is an elevational view, partly broken away, of a fluorescent lamp which incorporates the improved phosphor blend.

With specific reference to the form of the invention illustrated in the drawings, the lamp 10 as shown in FIG. 1 is generally conventional and comprises a sealed, elongated, light-transmitting envelope 12 having electrodes 14 operatively positioned therein proximate the ends thereof and enclosing a discharge-sustaining filling comprising mercury 16 and a small charge of inert ionizable starting gas, such as a few torrs of argon or mixed argon and neon, for example. When the lamp is energized, the resulting low-pressure mercury discharge generates ultraviolet radiations and a limited proportion of visible radiations, with the latter constituting a strong mercury line at 436 nm, a relatively strong green line at 546 nm, and a relatively weak line at 578 nm, with the composite mercury emission appearing blue to the eye.

Coated on the inner surface of the envelope is a layer 18 of phosphor means which comprises predetermined amounts and relative proportions of apatite-structured calcium fluorophosphate activated by antimony and manganese, and yttrium oxide activated by tervalent europium. The antimony activator constitutes from 0.4% to 1% by weight and the manganese activator constitutes from 1% to 1.5% by weight of the calcium fluoroapatite phosphor. The europium activator constitutes from 2% to 13% by weight of the yttrium oxide phosphor. The calcium fluoroapatite phosphor is responsive to the ultraviolet radiations generated by the discharge to provide a broad-band emission of visible radiations, and the yttrium oxide phosphor is responsive to the ultraviolet radiations generated by the discharge to provide a narrow emission in the red-orange region of the visible spectrum. The predetermined amounts and relative proportions of calcium fluoroapatite phosphor and the yttrium oxide phosphor are such that the total visible emissions from the energized lamp fall within the warm-white ellipse as inscribed on the x-y chromaticity ICI diagram.

Figure 3:
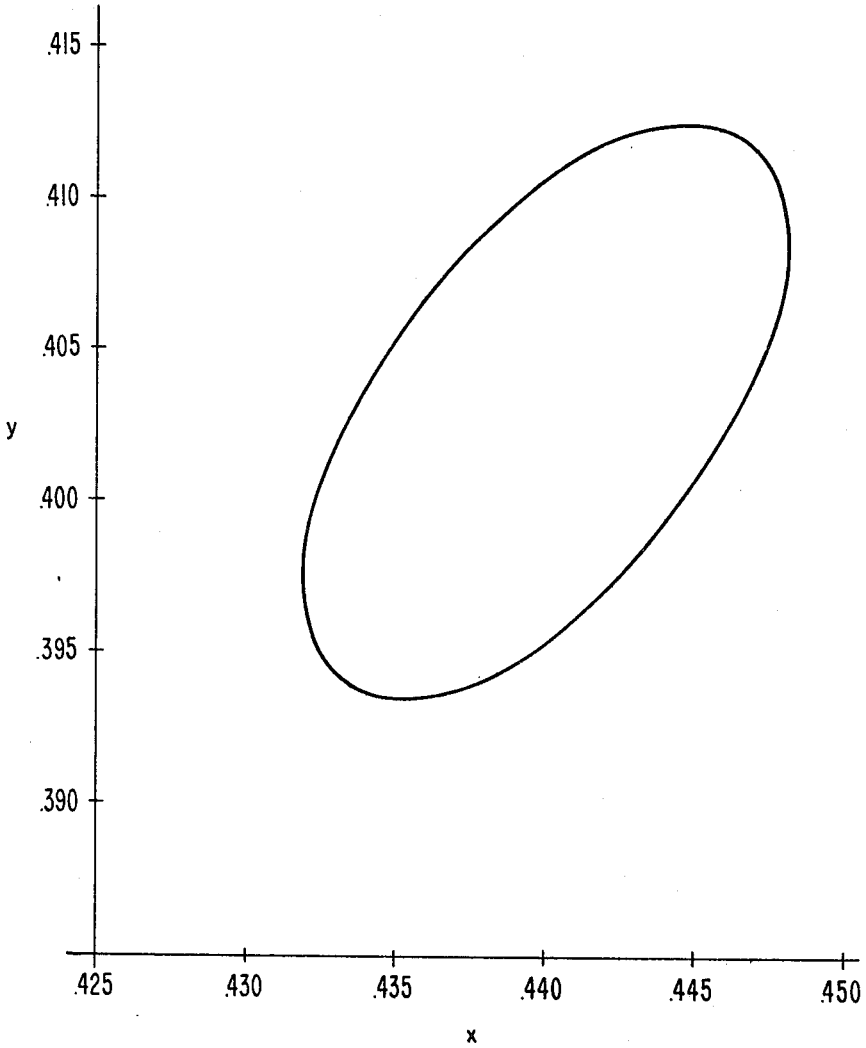
FIG. 3 is an enlarged showing of a portion of the ICI diagram which has inscribed thereon the so-called warm-white ellipse which describes the limits for the ICI coordinates for a lamp of this color temperature.
Figure 2:
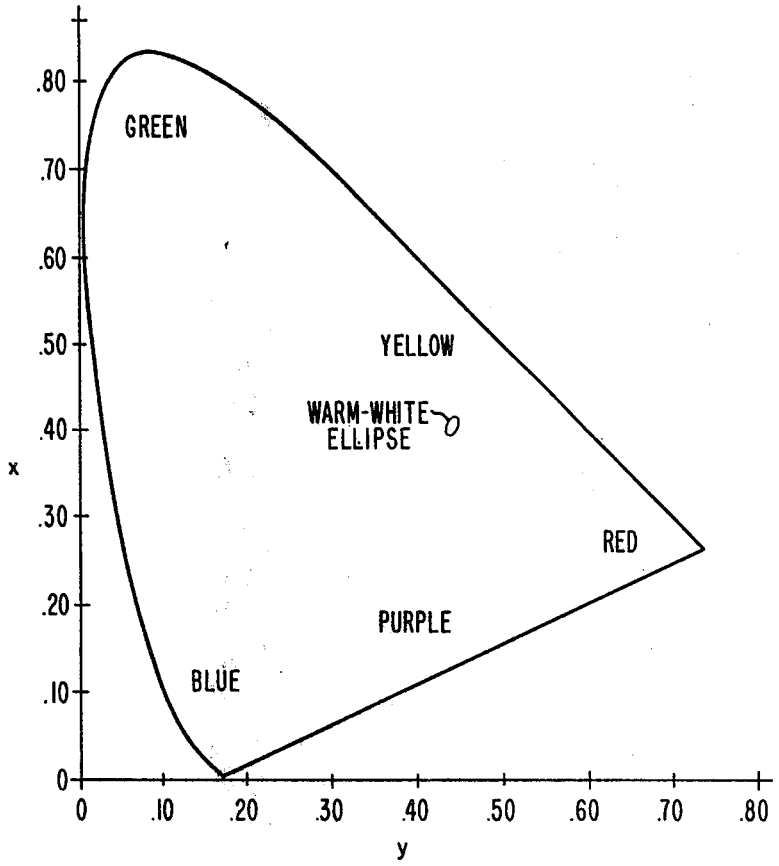
FIG. 2 is a reproduction of the x-y chromaticity diagram of the ICI system.

The ICI chromaticity diagram is shown in FIG. 2 with the so-called warm-white ellipse inscribed thereon and an expanded portion of the ICI diagram with the warm-white ellipse inscribed thereon is shown in FIG. 3. The total visible emissions from the energized lamp should fall within this ellipse, in order that the lamp will have the specified warm-white color.

In order to prepare the present calcium fluoroapatite phosphor, three moles of $CaHPO_4$ are mixed with 1.108 moles $CaCO_3$, 0.45 mole $CaF_2$, 0.142 mole $MnCO_3$, 0.05 mole $CdCO_3$, and 0.025 mole $Sb_2O_3$. Preferably 0.09 mole of $NH_4Br$ is added as a reaction promoter although the bromine does not enter into the final composition. The foregoing ingredients are thoroughly mixed and are fired at a temperature of 1160° C. for three hours in a nitrogen atmosphere. Thereafter, the finished material is reduced to finely divided status, preferably washed with a dilute solution of nitric acid, water washed, and spray dried. The cadmium need not be used, but a small addition is preferred for best performance. The phosphor can be expressed by the formula $3Ca_3(PO_4)_2\ CaF_2$:Sb,Mn. In the final phosphor, the antimony activator constitutes from 0.4% to 1% by weight of the phosphor and the manganese activator constitutes from 1% to 1.5% by weight of the phosphor, with the preferred activator concentrations being about 0.7% by weight antimony and 1.3% by weight manganese. As a specific example, the phosphor has an average particle size of about twelve microns.

To prepare the yttrium oxide phosphor, yttrium oxide and europium oxide are mixed in the desired gram mole ratios as described in the final phosphor, together with from 5% to 30% by weight of zinc chloride as a flux, with the preferred flux addition being from 10% to 20% by weight of the phosphor constituents. The foregoing constituents are fired at from 1250° C. to 1400° C., with 1350° C. being preferred, for a period of from three hours to twenty hours, with twelve hours being preferred. The phosphor can be expressed by the formula $(Y_{1-x}Eu_x)_2O_3$, wherein x is from 0.03 to 0.2, with the preferred value of x being 0.09. In the final phosphor, the europium constitutes from 2% to 13% by weight of the phosphor with about 6% by weight europium being preferred. After firing, the phosphor is reduced to finely divided status and is thereafter ready for coating.

For coating onto the envelope as shown in FIG. 1, the phosphors are mixed in the weight ratio of about 79% calcium fluoroapatite and about 21% yttrium oxide. The coating technique is conventional wherein the phosphors are suspended as a slurry in a vehicle such as water, with a small amount of organic binder material, with added components such as wetting and deflocculating agents. After application of the slurry to the inner surface of the envelope, the envelope is lehred to volatilize the organics leaving the resulting phosphor material evenly adhered thereon as a powder layer. As a specific example, for a 40WT12 size lamp, approximately 6 grams of the foregoing phosphor mixture are utilized. Details of coating techniques are described in U.S. Pat. Nos. 3,832,199 dated Aug. 24, 1974 to Repsher et al. and 3,833,392, dated Sept. 3, 1974 to Repsher et al.

Figure 4:
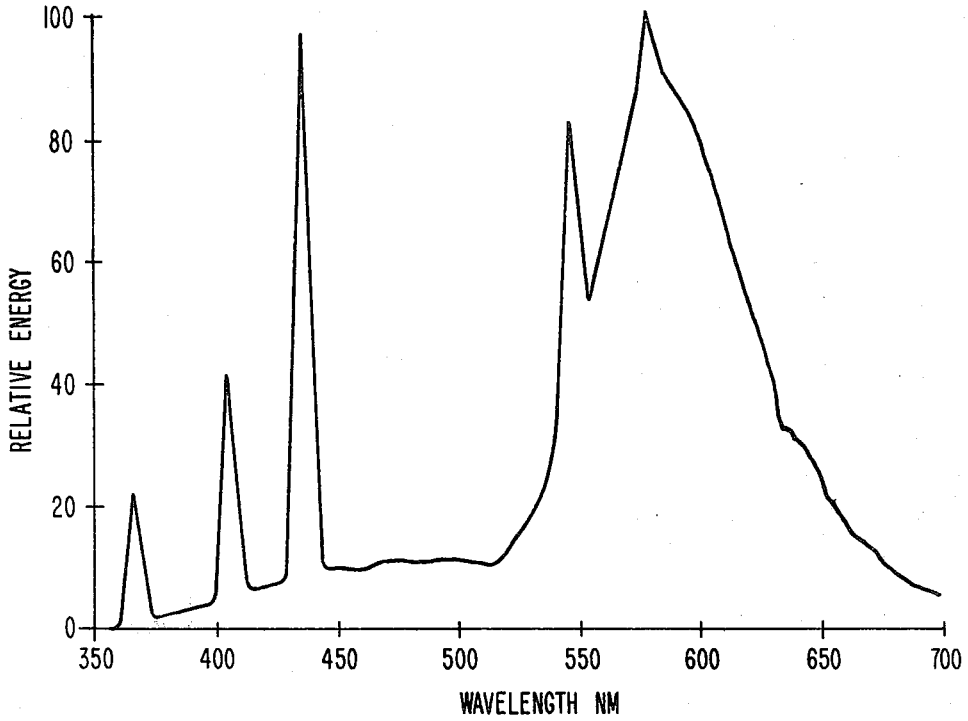
FIG. 4 is a graph of relative energy versus wavelength setting forth the spectral power distribution for a standard warm-white fluorescent lamp which incorporates a halophosphate phosphor.

A typical warm-white halophosphate of the prior art comprises the following in the indicated gram-atom proportions of ingredients: Ca,4.7; $P_2O_5$,1.5; Mn,0.17; Sb,0.1; F,1.0; Cl,0.5; and Cd,0.05. The spectral power distribution (SPD) for a lamp incorporating such a phosphor is shown in FIG. 4, wherein the peak of emission occurs at about 580 nm, with the maximum measured emission in the SPD correlated as 100 on the ordinate. Superimposed onto the emission of the halophosphate phosphor are the mercury lines, which together with the phosphor emission comprise the composite lamp emission.

Figure 5:
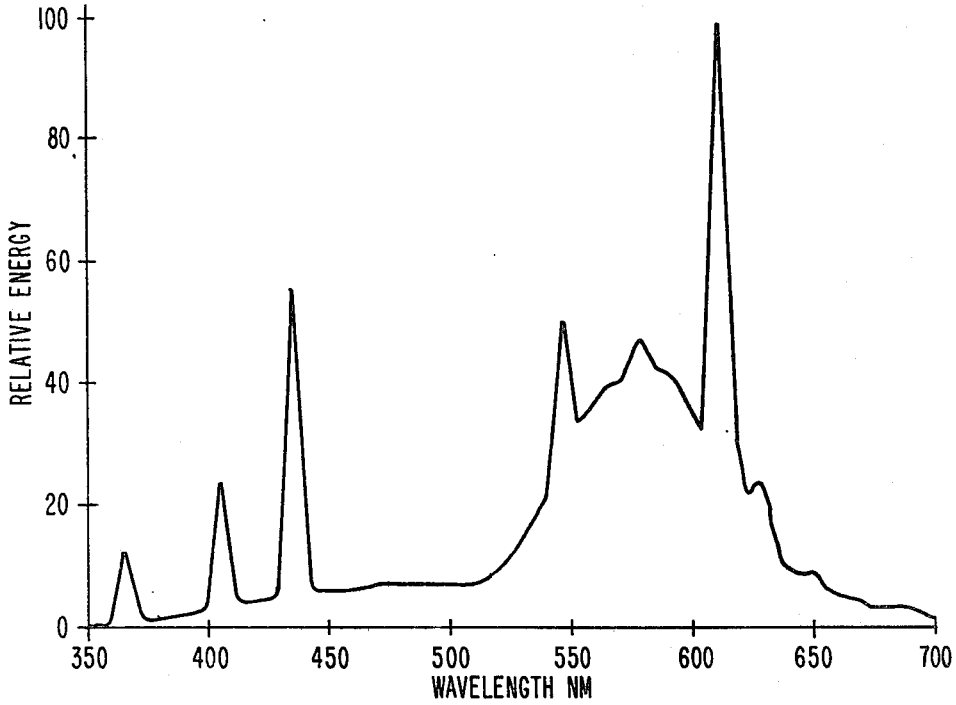
FIG. 5 is a graph of relative energy versus wavelength setting forth the spectral power distribution for a fluorescent lamp which incorporates a mixture of the calcium fluoroapatite and yttrium oxide phosphors mixed in such proportions as to provide a warm-white color for the composite lamp emission, in accordance with the present invention.

Shown in FIG. 5 is the spectral power distribution for the preferred lamps of the present invention, wherein the maximum emission occurs at about 612 nm, which represents the emission of the yttrium oxide phosphor. As in the previous SPD, the maximum emission is correlated as 100 on the ordinate. In actual performance tests, for 40 watt T12 fluorescent lamps having a warm-white color, the lamps utilizing the present mixture of the calcium fluoroapatite plus yttrium oxide phosphor display a 100-hour output of 3188 lumens, with the color coordinates being x=0.441 and y=0.412. Corresponding standard warm-white lamps of the prior art display an average 100-hour lumen output of 3102, with color coordinates of x=0.443 and y=0.412. The color rendering index of the present lamps average 60, as compared to a color-rendering index of 51 for the standard warm-white halophosphate phosphor lamps. Equally important, the measured color preference index of the present lamps is 52, as compared to a color preference index of 37 for the prior art standard warm-white lamps. Warm-white deluxe lamps fabricated of the phosphor blend as described hereinbefore display a 100-hour lumen output of 2,250, with color coordinates of x=0.425 and y=0.385, and a color rendering index of 64. Thus it can be seen that the present phosphor blend not only has improved lumen output over the standard warm-white lamp of the prior art, but the color rendering index of the present lamps is almost as good as the color rendering index of the prior art warm-white deluxe lamps which have a substantially decreased lumen output.

Various other embodiments are possible. For example, the europium-activated yttrium oxide phosphor is a relatively expensive constituent. If the phosphor is coated as two separate distinct layers, such as described in U.S. Pat. No. 3,602,758, the amount of the expensive yttrium oxide component can be reduced by about fifty percent. In fabricating such a lamp embodiment, the calcium fluoroapatite phosphor is first deposited as a uniform layer directly on the inner surface of the envelope and the europium-activated yttrium oxide is then coated thereover, in order that the amount of the more expensive material is substantially reduced.

What is claimed is:

1. A fluorescent lamp having a warm-white color and combined high efficacy and good color rendition, said lamp comprising a sealed elongated light-transmitting envelope having electrodes operatively positioned therein proximate the ends thereof and enclosing a discharge-sustaining filling comprising mercury and a small charge of inert ionizable starting gas which when energized generates a discharge comprising ultraviolet radiations and a limited proportion of visible radiations, phosphor means carried on the interior surface of said envelope, said phosphor means comprising predetermined amounts and relative proportions of apatite-structured calcium fluorophosphate activated by antimony and manganese and yttrium oxide activated by tervalent europium, said antimony activator constituting from 0.4 to 1 weight percent and said manganese activator constituting from 1 to 1.5 weight percent of said apatite-structured calcium fluorophosphate phosphor, said europium activator constituting from 2 to 13 weight percent of said yttrium oxide phosphor, said apatite-structured calcium fluorophosphate phosphor responsive to the ultraviolet radiations generated by the discharge to provide a broad band emission of visible radiations, said yttrium oxide phosphor responsive to the ultraviolet radiations generated by the discharge to provide a narrow emission in the red-orange region of the visible spectrum, and the predetermined amounts and relative proportions of said apatite-structured calcium fluorophosphate phosphor and said yttrium oxide phosphor being such that the total visible emissions from said energized lamp fall within the warm-white ellipse as inscribed on the x-y chromaticity diagram of the ICI system.

2. The lamp as specified in claim 1, wherein said apatite-structured calcium fluorophosphate phosphor and said yttrium oxide phosphor are finely divided and uniformly mixed as a powder layer, with the relative weight proportions of said apatite-structured calcium fluorophosphate phosphor and said yttrium oxide phosphor being about 79:21.

3. The lamp as specified in claim 2, wherein said antimony activator constitutes about 0.7 weight percent and said manganese activator constitutes about 1.3 weight percent by weight of said apatite-structured calcium fluorophosphate phosphor, and said europium activator constitutes about 6 weight percent of said yttrium oxide phosphor.

* * * * *